US005463921A

United States Patent [19]

Bellio et al.

[11] Patent Number: 5,463,921

[45] Date of Patent: Nov. 7, 1995

[54] METHOD AND APPARATUS FOR AUTOMATED HANDLING OF CUT MATERIAL

[75] Inventors: Stephen L. Bellio, West Roxbury; Edward Bernardon, Bedford; Mark J. Condon, Brighton; Robert S. Flory, Concord; Donald C. Fyler, Needham; Mitchell L. Hansberry, Framingham; Tommy W. Lee, Wilmington; James F. Mueller, North Reading, all of Mass.

[73] Assignee: The Charles Stark Draper Laboratory, Inc., Cambridge, Mass.

[21] Appl. No.: 27,098

[22] Filed: Mar. 5, 1993

[51] Int. Cl.[6] ..... B26D 7/18; B26D 7/20

[52] U.S. Cl. ..... 83/151; 83/152; 83/650; 83/937; 83/939

[58] Field of Search ..... 83/151, 152, 153, 83/102, 650, 937, 939; 112/121.15, DIG. 2, DIG. 3; 271/18.3, 107

[56] References Cited

U.S. PATENT DOCUMENTS

| | | | |
|---|---|---|---|
| 3,176,979 | 4/1965 | Englemann | 271/18 |
| 3,672,249 | 6/1972 | Sasaki | 83/152 X |
| 4,372,548 | 2/1983 | Aurich et al. | 271/18.3 |
| 4,392,766 | 7/1983 | Blunt | 271/107 X |
| 4,579,331 | 4/1986 | Nestler et al. | 271/18.3 |
| 4,632,046 | 12/1986 | Barrett et al. | 112/121.14 |
| 4,638,749 | 1/1987 | Wood | 112/121.12 |
| 4,679,784 | 7/1987 | Porat et al. | 271/18.3 |
| 4,822,022 | 4/1989 | Attenasio | 271/97 |
| 5,039,078 | 8/1991 | Blessing et al. | 271/18.3 X |
| 5,087,315 | 2/1992 | King et al. | 271/18.3 X |
| 5,090,669 | 2/1992 | Pieroni | 269/54.5 |
| 5,230,764 | 7/1993 | Moll | 112/DIG. 3 X |

OTHER PUBLICATIONS

M. K. Hall; B. Loweth; Methods for Auto–Separation of Fabric Plies from a Cut Stack; Knitting International 94; No. 1125: pp. 162–166 (Sep. 1987).

Schultz, "Grippers for Flexible Textiles," IEEE–91 ICAR, Institut für Textil–und Verfahrenstechnik, pp. 759–764, 1991.

"Single Ply Fabric Pick–Up Devices: A Cross Section of Patented and Available Devices," AAMA Apparel Research Journal, Dec. 1975, pp. 89–99.

Parker et al., "Robotic Fabric Handling for Automating Garment Manufacturing," Journal of Engineering for Industry, vol. 105, pp. 21–26, Feb. 1983.

*Primary Examiner*—Rinaldi I. Rada

*Attorney, Agent, or Firm*—Lappin & Kusmer

[57] ABSTRACT

Method and apparatus for nondestructively removing a cut segment of predetermined shape from a limp material sheet workpiece and transporting the cut workpiece segment to a staging area for further processing. The cut segment is picked up by a picker which may comprise an array of carding strips, each strip having a plurality of needle-like elements, arranged such that each strip can be displaced relative to its adjacent strips and the needle-like elements of each strip are angularly offset with respect to the needle-like elements of the adjacent strips. Such removal and transporting having is accomplished without distorting the shape of the cut segment.

9 Claims, 6 Drawing Sheets

METHOD AND APPARATUS FOR AUTOMATED HANDLING OF CUT MATERIAL

FIELD OF THE INVENTION

This invention relates to systems for automated or computer-controlled assembly of cut material, such as for picking and transporting of cut segments of limp material for downstream processing.

BACKGROUND OF THE INVENTION

In the limp material assembly field, individual segments are cut from sheet material, and these cut segments are then delivered to a staging area to be assembled in various combinations (hereinafter "preforms"), perhaps with other materials. These preforms are then processed into various products and articles.

Although cutting and sewing generally is an old and well-known art, there is a continuing need to adapt to the special features of newly developed limp materials. Many of these new materials are light weight and delicately woven, yet are tough and durable, such materials include specialty synthetics used in outerwear, or epoxy-graphite materials ("composites") used in sporting goods, radomes, and the like.

More particularly, in the construction of composite parts by resin transfer molding processing, a preform is made of layers of dry woven composite materials such as fiberglass or carbon fibers. This preform is then put in a mold and injected with resin to make the finished part. These preforms can be difficult and time consuming to make. On one hand, the preform must be precisely assembled for quality control reasons, and on the other hand, composite materials tend to be loosely woven and tend to distort and unravel at the slightest of handling. There is therefore a need for improved means for removing individual cut segments from a cut sheet of delicate, limp material, while both maintaining the shape of the removed segment and without disturbing both the remaining cut segments and the scrap.

Presently known equipment and processes do not adequately address this material-handling issue in a cost-effective manner. Yet obtaining cost-effectiveness is a high priority in a globally competitive market. Hence any solution must be capable of handling delicate, cut material segments with a minimum of material distortion, and must be able to do so in volume, in a highly repeatable manner, and with a minimum of scrap and waste.

A further problem is noted during handling of impregnated special materials, such as resin impregnated fibers, where the materials have a surface tackiness. Here it is necessary to be able to remove a cut segment from the remaining material without having the remaining material adhere to the picking device. In addition, the picking device must be able to gently unload the picked cut segment and to deliver it to a staging area in a smooth and undamaged condition, notwithstanding such material surface tackiness.

It is therefore an object of the present invention to provide a method and apparatus for automated limp material handling which overcomes the deficiencies of the prior art.

It is a further object of the present invention to provide a method and apparatus for picking up a cut segment of limp material and delivering it to a staging area with the ability of accurate positioning and without distortion of the picked segment.

SUMMARY OF THE INVENTION

The present invention provides a method and apparatus for removing a cut segment of predetermined shape from a limp material sheet workpiece while maintaining the shape of the removed segment. The cut workpiece segment may then be transported to a staging area for further processing. In general, the method of the invention includes the steps of positioning the combination of a cover sheet overlying a workpiece sheet on the cutting surface of a cutting table, and then cutting the cover sheet and workpiece sheet. This cutting defines the boundary of a cut workpiece segment and the boundary of an associated, correspondingly shaped, cut cover segment cut from the cover sheet immediately above, i.e., overlying, the cut workpiece segment. The boundaries of the cut workpiece segment and the cut cover are thus substantially coincident. The method further includes the step of using a picker to remove the cut cover segment while the remainder of the cover sheet and the entire workpiece sheet remain non-distorted, i.e., undisturbed. Then a picker is used to grasp and remove the workpiece segment, maintaining that segment in an undistorted condition, while the remainder of the cover sheet and of the workpiece sheet also remain non-disturbed. If desired, the picker may transport and deliver the removed workpiece segment to a downstream staging area, all while maintaining that segment in an undisturbed condition.

In accordance with a preferred embodiment of the invention, a combination of a cover sheet, a workpiece sheet and pickers are selected in accord with the following: (1) the cut cover sheet segment picker is able to lift the cut cover sheet segment to expose the underlying cut workpiece segment without disturbing the remaining cover sheet or the exposed cut workpiece segment or the balance of the workpiece sheet; and (2) the cut workpiece segment picker is able, in a non-distorting manner, to grasp, lift and, if desired, then articulate, the thus exposed cut workpiece segment without distorting or harming the workpiece segment and without disturbing the remaining sheets, for delivery of the cut workpiece segment to a downstream staging area.

In a preferred embodiment of the invention, the cover segment picker has a picking ability which is effective for the cover sheet material but ineffective for the workpiece material. For example, where the cut cover sheet segment is to be picked up by a vacuum picker, the cover sheet may be a plastic film or a foil while the workpiece sheet may be a loosely woven fabric. At the same time, the cut workpiece segment picker has a picking ability which is effective for the material of the workpiece sheet, but which is relatively ineffective for the cover sheet material. Preferably, the workpiece segment picker includes a carding device (bearing multiple arrays of flexible needle-like elements) and the workpiece sheet material is a cloth, e.g., knitted, woven, coiled, felted, or the like, as may be penetrated and captured by the needle-like elements of the workpiece segment picker. In that case, the cover sheet material is preferably a substantially solid sheet which is impenetrable by the needle-like elements of the workpiece segment picker, e.g., the cover sheet can be a foil. In one embodiment, the workpiece sheet is a sheet of graphite fabric and the cover sheet is a sheet of plastic film.

In one form of the invention in which the workpiece sheet and cover sheet are supported on a planar workpiece support surface, the workpiece segment picker includes an articulated carding-type end effector which is moveable over the workpiece support surface. The end effector includes a base plate and a shift plate. These plates are mounted in a housing with respect to each other to facilitate relative motion therebetween along a shift axis substantially parallel to the workpiece support surface. A shift assembly is mounted on the base plate to effect the shifting as desired (i.e., to control pick-up and release of a cut workpiece segment). An array of adjacent, interleaved, narrow strips of carding is mounted on each of the plates. This carding preferably takes the form of a material having an array of substantially parallel flexible needle-like elements that extend out from the plates, tilted from the normal, and most preferably each element includes a "dog-leg" bend. Alternating sets of adjacent strips of the carding are arranged on the plates, with the tilt of the respective sets of needle-like elements being at opposite angular offsets. By shifting the adjacent strips in a first set of opposite directions, the needle-like elements may be biased against the material to grasp it and by shifting the adjacent strips in a second set of opposite directions, the needle-like elements-may release the material.

In an alternative embodiment, a workpiece segment picker mechanism is provided which is particularly well suited for use with workpiece sheet material without a non-penetrable (e.g., plastic) cover sheet. This form of the invention is useful for materials having either a tacky or a dry surface. This alternative workpiece segment picker also includes interleaved arrays of shiftable picker (e.g., carding) strips. However, in addition, each picker strip is formed of a multiplicity of individual picker sub-sections. Each picker sub-section is provided with its own linear actuator and is individually actuatable normal to the shifting axis. In this alternative embodiment, a controller establishes the ability to individually actuate selected picker sub-sections for picking of random workpiece shapes (subject to resolution limits imposed by the sub-segment size) without disturbing adjacent plies on the workpiece support surface by actuation of only those sub-sections which actually overlie the target workpiece segment.

In this alternative form, the distal ends of needle-like elements of the inactivated picker sub-sections lie in a rest plane, while the distal ends of the activated sub-sections extend out to a picking place. With this configuration, only the activated picker sub-sections operate to grasp and remove a cut workpiece segment.

In the above form of the invention, there may also be stripper blades extending between adjacent picker strips. In the embodiments including such stripper blades, the blades are selectively moveable (under the control of a controller) with respect to the picker strips in the direction perpendicular to shift axis, so that the distal surfaces of the blades extend to a blade plane positioned beyond the tips of the needle-like elements or may be withdrawn so that the distal surfaces of the blades lie in an intermediate plane, below the tips of the needle-like elements. With the blades in the intermediate plane, the picker strips may grasp or release a cut workpiece segment, as desired. The blades may be shifted to the blade plane to force the release of a grasped workpiece. The latter operation is particularly useful to release a tacky segment from the actuated sections as these sections are retracted back into the resting plane. In a preferred embodiment, the distal surfaces of the stripper blades are provided with a quick-release non-stick coating, such as polytetrafluoroethylene (PTFE).

BRIEF DESCRIPTION OF THE DRAWING

These and other features and advantages of the present invention will be more fully understood by reference to the following detailed description in conjunction with the attached drawing in which like reference numerals refer to like elements and in which.

DETAILED DESCRIPTION OF PREFERRED EMBODIMENTS

Figure 1:
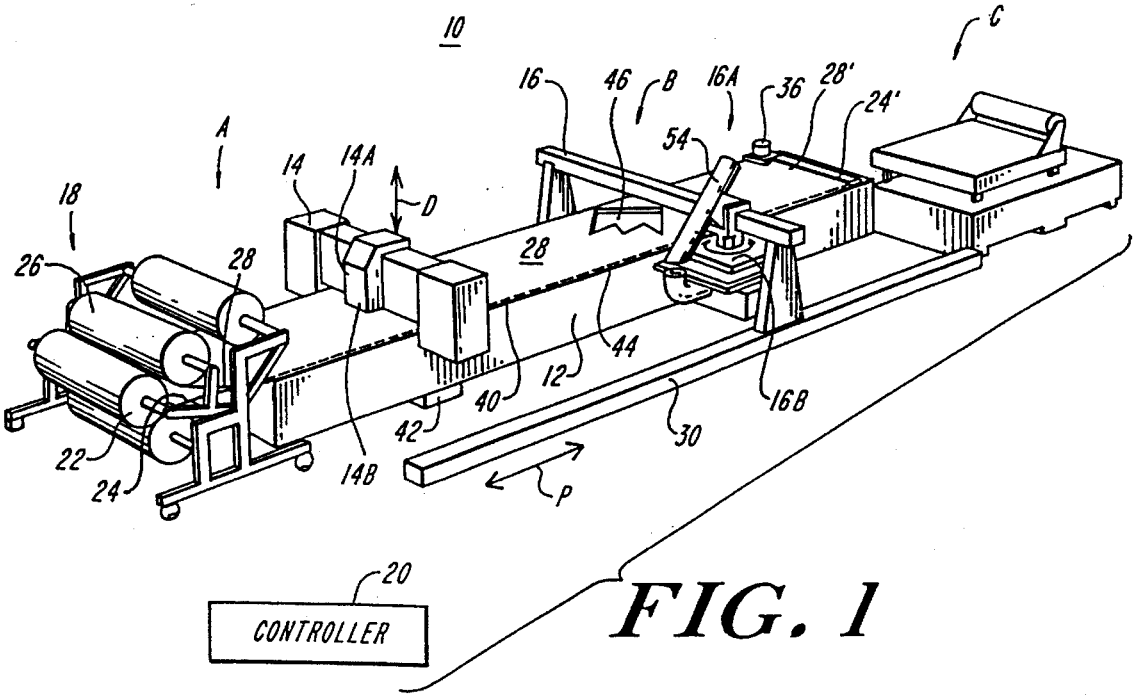
FIG. 1 is a perspective view of an apparatus according to the invention.
Figure 2:
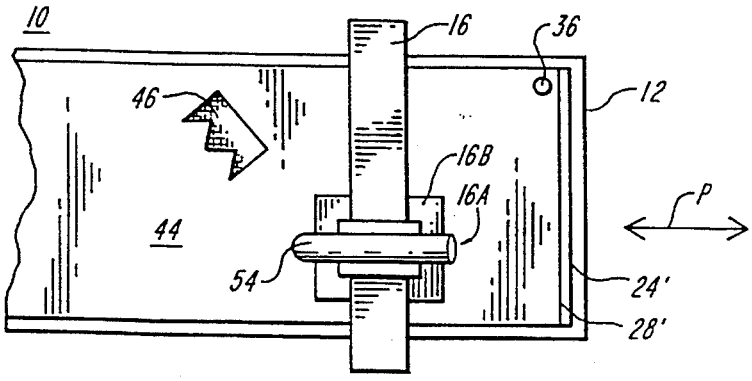
FIG. 2 is a is a partial top view of the apparatus of FIG. 1.

Referring now to FIGS. 1 and 2, a system 10 according to the invention for selecting a cut workpiece segment of predetermined shape from a workpiece material sheet and transporting the selected segment to a staging work area for further processing will now be described. System 10 includes a cutting table 12, a dispensing and cutting gantry 14, a picker gantry 16, and a sheet material dispenser assembly 18, all under the direction and control of controller 20. The material dispenser assembly 18 includes a first roll 22 of workpiece material sheet 24 and a second roll 26 of cover material sheet 28. Gantries 14, 16 are each motor driven along principal axis P of table 12 and ride on a pair of parallel horizontal guide rails 30 (only one shown) attached to and extending along the principal axis on a respective side of the table.

Gantry 14 includes a clamping mechanism 14A and a cutting mechanism 14B. Generally speaking, gantry 14 is initially positioned at sheet loading station A, as shown in FIG. 1, and it is from this station that the sheets of workpiece material and cover material are grasped by clamping mechanism 14A and are drawn over the cutting table until they extend between loading station A and a tie down station B. Gantry 14 is operated under control of controller 20, which may take the form of a programmed digital computer, or like device.

More specifically, the free ends 24' and 28' of material 24 and cover sheet 28 are captured by clamping mechanism 14A on gantry 14. The gantry 14 is then driven from station A over the table (along rails 30) to station B, where the free ends 24', 28' of workpiece sheet 24 and cover sheet 28 are released by mechanism 14A, and may be secured by a clamping device 36 on the table at station B. A vacuum is then applied by vacuum supply 42 to the cutting bed 40 to secure in place the applied workpiece-cover sheet assembly 44.

Figure 3:
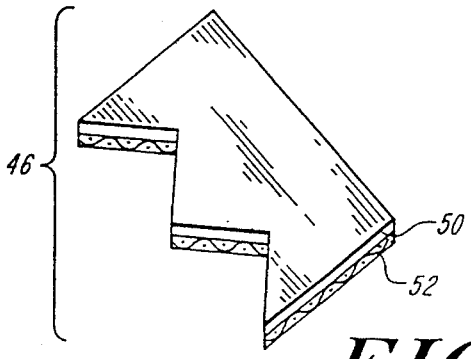
FIG. 3 shows a cut workpiece segment with its overlying associated cut cover segment.

Once the workpiece-cover sheet assembly 44 is secured to the table, then controller 20 directs gantry 14 to pass over the surface of the assembly to enable cutting mechanism 14B to cut predetermined patterns in the sheets. Cutting mechanism 14B thus cuts and defines the boundary of a desired workpiece segment from the workpiece sheet while simultaneously cutting the boundary of an associated, correspondingly shaped, cover segment from the cover sheet immediately above the workpiece segment, with these cut boundaries lying coincidentally. For example, as shown in FIG. 3, sample pattern 46, having been cut into sheet assembly 44 by cutting mechanism 14B, defines a cut cover segment 50 over a cut workpiece segment 52.

The cutting process is repeated until all desired patterns have been cut in the sheet assembly 44. After such cutting is complete, gantry 14 is driven back to station A where it will not obstruct subsequent operation of gantry 16.

Cutting mechanism 14B may take the form of knife cutters, "pizza wheel" cutters, ultrasonic cutters, laser cutters, or other conventional forms.

While it is possible to cut a delicate material sheet with great precision, such as with the devices described above, the cutting and laying up (processing) of the cut segments, for example segments cut from graphite fiber sheets in the construction of graphite-epoxy composite structures, requires a high degree of gentle handling in order to preserve the integrity of the cut segment, i.e., to prevent the material knit or weave from unraveling or mis-shaping during picking and transporting of the cut segment to a downstream assembly area. In this embodiment, this need is met by the apparatus of a single picker gantry 16. Gantry 16 stands idle beyond station B until gantry 14 has performed its assigned functions and returned to station A. Gantry 16 is then driven into position under the direction of controller 20.

Figure 4:
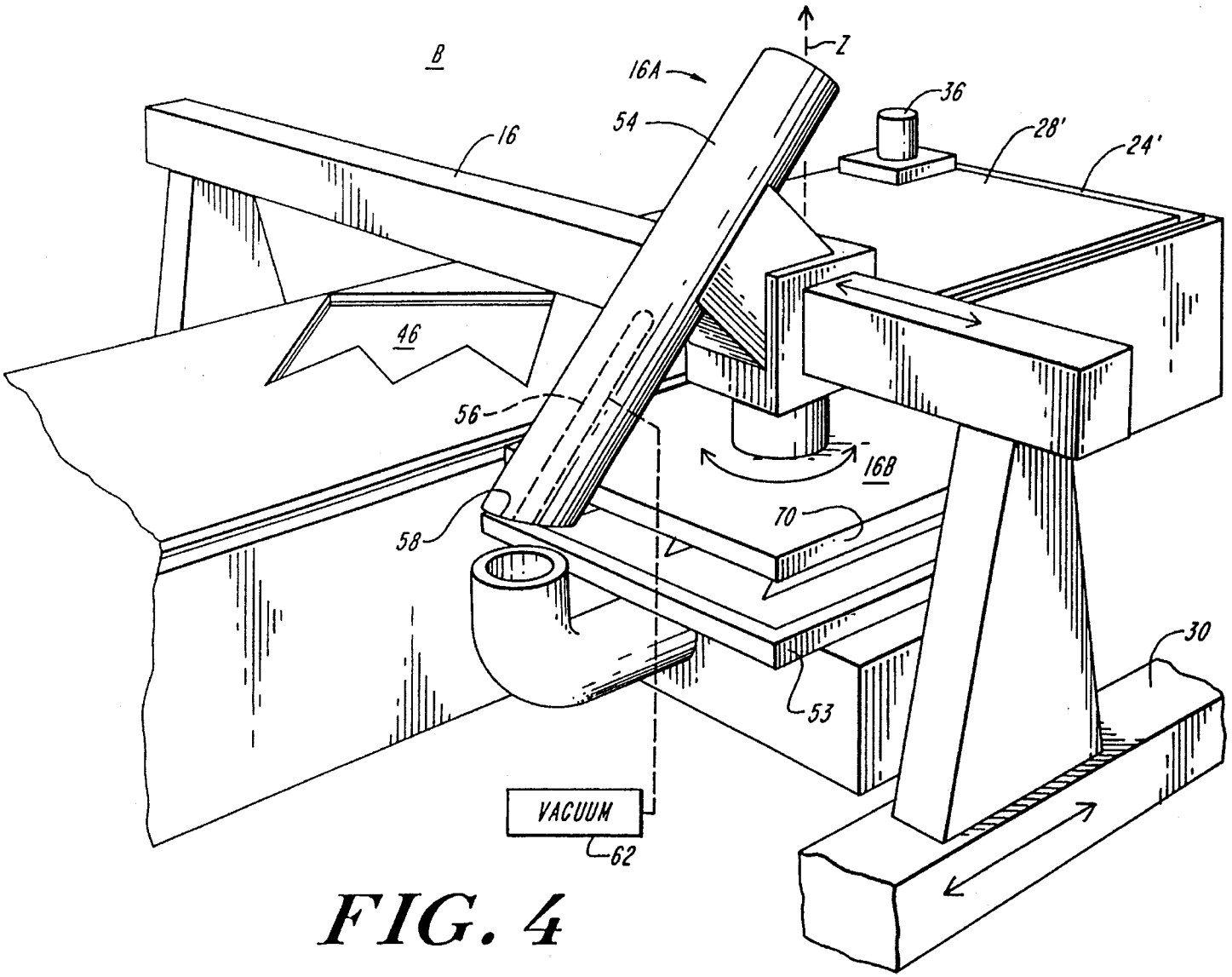
FIG. 4 is a side view of a picker gantry with two picker mechanisms of the invention.

Generally speaking, picker gantry 16, such as the one shown in FIG. 4, includes a cover segment picking mechanism 16A and a workpiece segment picking mechanism 16B, all of which is operated under control of intelligent controller 20, and are provided with means for motion normal to the principal axis along a deployment or cutting axis Z, and preferably normal to the plane of the laid-out sheets on the table. The cover segment picking mechanism 16A is positioned over the cut pattern of interest, such as pattern 46, and is driven along the cutting axis to engage and remove the cover segment 50, thereby exposing the targeted cut workpiece segment 52. Next, the segment picking mechanism is retracted and workpiece segment picking mechanism 16B is driven overhead of the exposed workpiece segment 52. Now picking mechanism 16B is lowered along axis Z to engage workpiece segment 52, the latter then being picked up, articulated and transported, as necessary, by picker mechanism 16B and off-loaded at a lay-up table 53 or the like at staging area C, for further action as desired.

In a preferred embodiment of the invention, cover segment picking mechanism 16A includes a tube housing 54 mounted to gantry 16 and an actuator arm 56 mounted within housing 54. The actuator arm terminates at its distal end with a suction end effector 58, which is coupled to vacuum source 62 (not shown). When picking mechanism 16A is adjacent to the cut cover segment-to-be-picked, the actuator arm 56 is extended and the end effector 58 engages cut cover segment 50 and, with the picker vacuum supplied by source 62, captures segment 50. The actuator arm then is retracted within tube 54 of picking mechanism 16A, pulling the captured segment 50 within the tube and clearing the path for the workpiece segment picking mechanism 16B to lift and transport the exposed workpiece segment 52 to the staging area C.

For optimum performance of the present invention, it is preferable that whatever picker arrangement is used to pick the cut cover segment from the cutting table, the cut cover segment picker is effective for the material forming the cover sheet and ineffective for the material forming the workpiece. In this manner, the cut cover segment can be picked without disturbing any of the remaining materials. In the above embodiment, the cover material is a film such as a plastic sheet and which is impenetrable to the applied picker vacuum, thus insulating the underlying workpiece segment 52 from disturbance by the vacuum action of the cover segment picking mechanism 16A.

In a preferred embodiment of the invention, workpiece segment picking assembly 16B takes the form of an articulated, carding-type end effector apparatus 68. As shown in FIGS. 5A–5E, apparatus 68 includes a base plate 70 overlying a shift plate 72. Both plates extend along a shift axis S which is nominally parallel to the planer workpiece support surface. The upper side of base plate 70 is mounted to one end of a shift assembly 78, the latter having an actuator device 80. The shift plate 72 is mounted to the actuator device 80, which is selectively operable to effect relative motion between the base and shift plates 70 and 72 along axis S. In the illustrated embodiment, the actuator device 80 is an air cylinder having an output shaft **80*a* which is displaceable between two end point positions. Shaft 80*a* is coupled by a linkage (not shown) to the plates 70 and 72 so that motion of shaft 80*a* between the two end point positions effects a corresponding relative motion of plates 70 and 72 along axis S, under control of controller 20**.

Figure 5A:
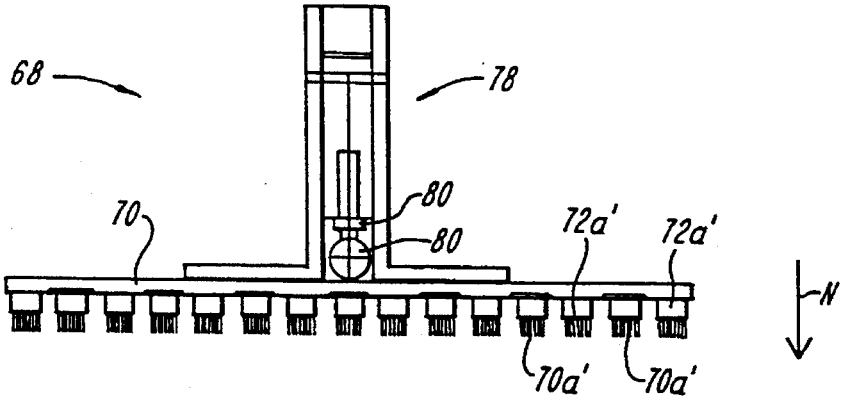
FIG. 5A is a side view of an embodiment of a workpiece picker mechanism of the invention.
Figure 5B:
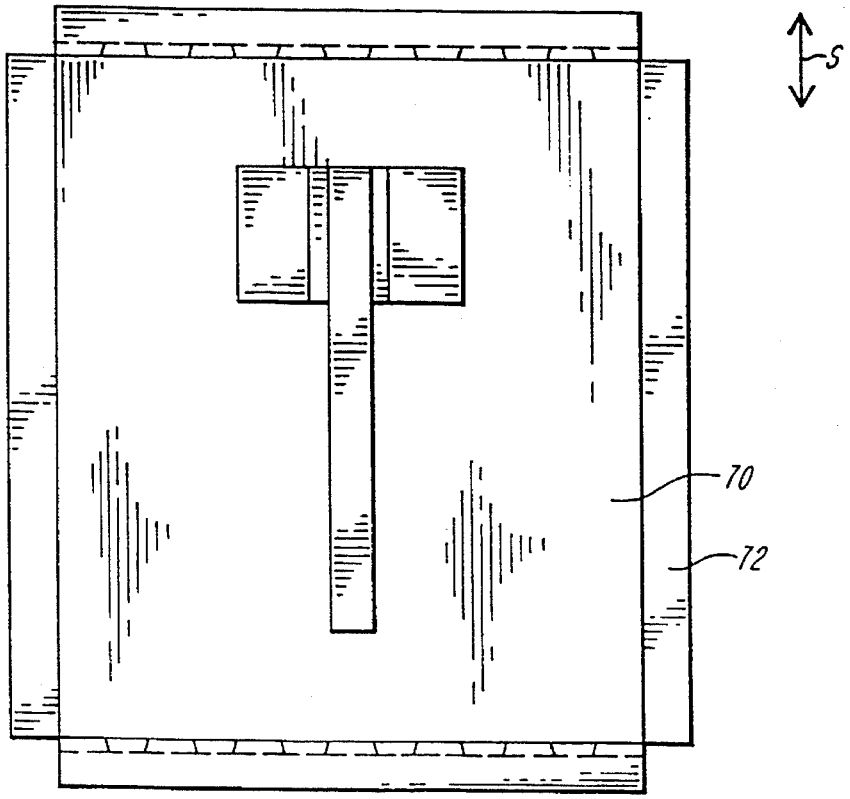
FIG. 5B is a top view of the embodiment of FIG. 5A.
Figure 5C:
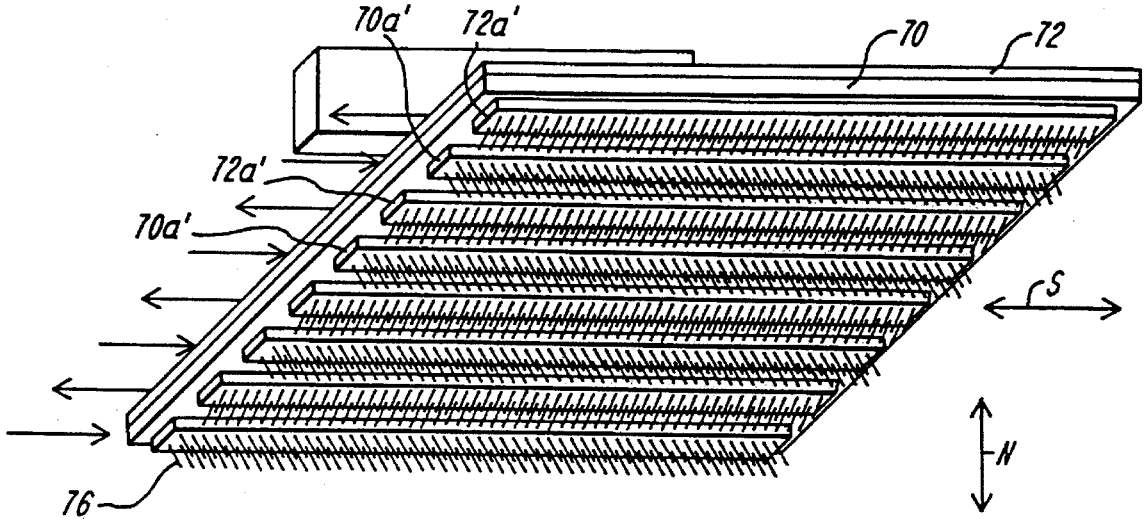
FIG. 5C is a perspective view of the carding-type picker mechanism of the embodiment of FIG. 5A.
Figure 5D:
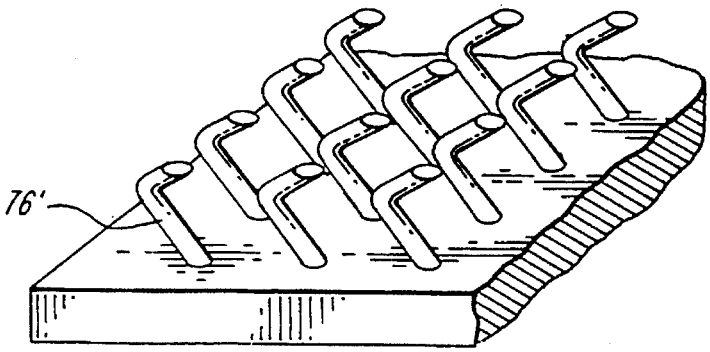
FIG. 5D is a side view of preferred dog-leg, needle-like elements of the carding-type picker mechanism of FIG. 5A.
Figure 5E:
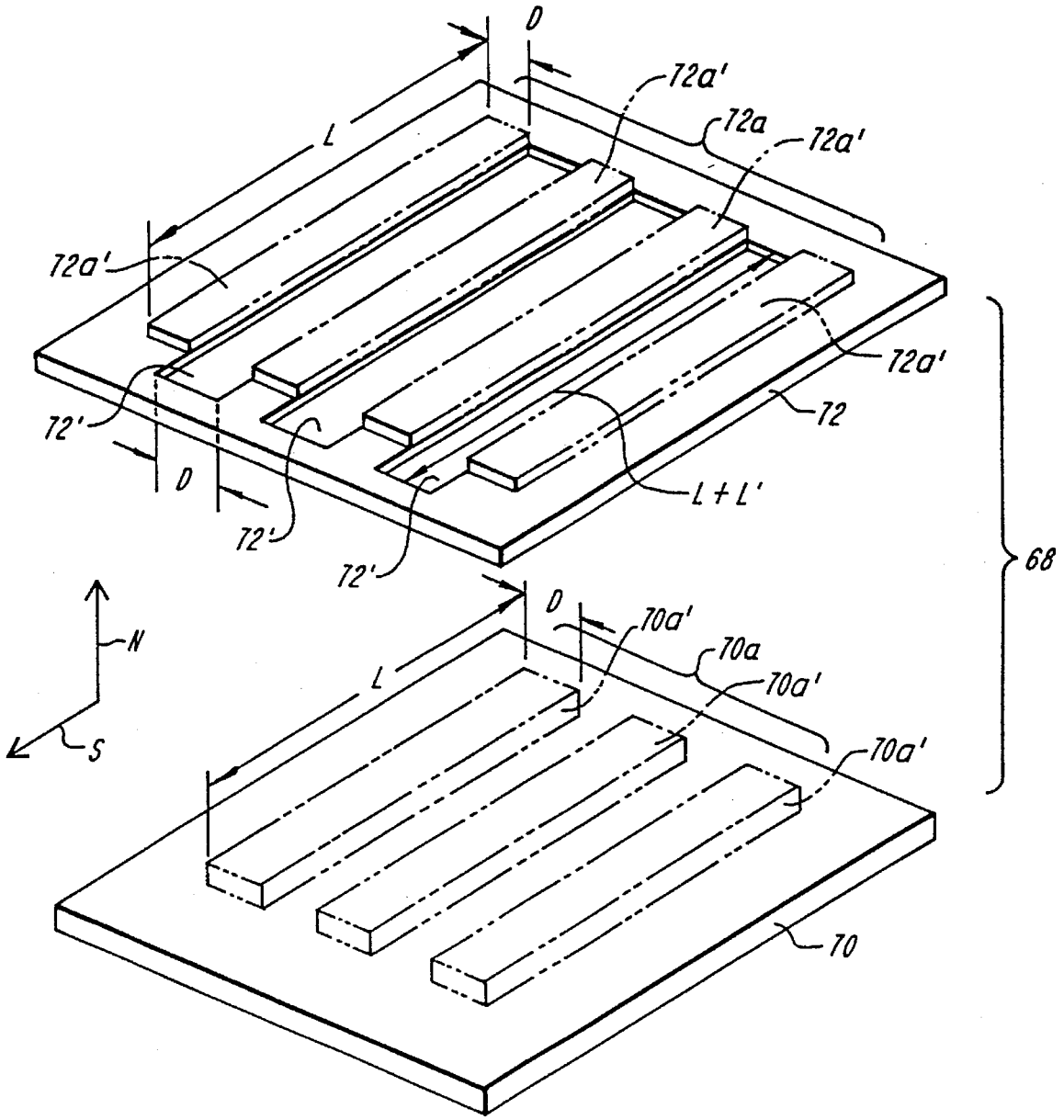
FIG. 5E is an inverted exploded view of the embodiment of FIG. 5A.

In the preferred embodiment, as shown in the inverted exploded view of assembly 68 in FIG. 5E, plate 70 is a rigid rectangular element that on its underside supports three carding elements **70*a*' of length L and width slightly less than D in an array 70*a*, where the carding elements are positioned side-by-side in a parallel relationship, separated by an inter-element gap slightly greater than D. Plate 72 is similar to plate 70. Plate 72 on its underside supports four carding elements 72*a*' of length L and width slightly less than D in an array 72*a*, where the carding elements are also positioned side-by-side in a parallel relationship separated by an inter-element gap slightly greater than D. The plate 72 has an array of elongated slots 72' passing therethrough with each slot being positioned between two carding elements and having a length L+L' (i.e. greater than L by L') in the direction of the S axis and a width equal to D in the direction transverse to the S axis. The carding elements of plate 72 are offset with respect to the carding elements of plate 70 so that the carding elements of array 70*a* protrude through the slots in plate 72 and together the two arrays of carding elements are interleaved to establish a uniform height, continuous carding array with substantially no inter-element gaps. When plate 72 is shifted relative to plate 70 in the direction of the S axis, the carding elements of the respective arrays 70*a* and 72*a*** are similarly shifted.

The carding elements of arrays **70*a* and 72*a* may take the form of a material having a plurality of substantially parallel resilient, needle-like elements 76 that extend out from the principal planes of their respective supporting plates 70 and 72. The needle-like elements in the carding elements of each array are uniformly tilted from the normal N to their respective supporting plates. Thus, in the composite array formed by arrays 70*a* and 72*a*, alternating sets of adjacent strips (e.g., strips 70*a*' and 72*a*') of carding are arranged on plates 70, 72 with the tilt of the respective sets of needle-like elements 76 being at opposite angular offsets. Thus, as seen in FIG. 5C, a first set of the alternating strips (e.g., 72*a*') of carding having needle elements with a first angular tilt is attached to base plate 70, and a second set of the alternating strips (e.g., 70*a*') having needle elements with a second (and opposite) angular tilt is attached to moveable shift plate 72**. Carding of the above type is available from Howard Brothers Mfg. Co., Auburn, Mass.

In FIG. 5E, the angles of the needle-like elements of the carding arrays are indicated by the slanted lines on the sides of the array shown. With this configuration, when the composite array is initially positioned with its carding element arrays having their bases minimally separated in the direction of the S axis (i.e. as shown in FIG. 5C), and then that composite array is biased against a woven fabric workpiece, and finally the carding element arrays are shifted with respect to each other so that their bases are minimally separated in the S direction, these needle elements of the respective arrays protrude into and firmly grip the workpiece, with the resilience of the needles biasing that gripping action. When this gripping process is reversed, the respective needle elements withdraw from the workpiece and the workpiece is released.

In a preferred embodiment, the needle-like elements are bent, having a "dog-leg" profile 76', as seen in FIG. 5D, which illustrates a two element piecewise linear needle form. Further, the needles of the illustrated embodiment have a planer distal surface. This particular dog-leg configuration further assists in providing the selective gripping and releasing of a workpiece by permitting establishment of a uniformly distributed projection of the respective resilient needle elements.

To pick up a cut workpiece segment 52, after the cut cover segment 50 lying over the targeted workpiece segment 52 has been removed, the workpiece segment picking mechanism 16B is engaged and brought to rest over the exposed work piece segment. The workpiece segment picking mechanism 16B is then deployed along axis Z, approaching the exposed workpiece segment 52 until the needle-like elements 76 begin to make contact with the surface of segment 52, as actuator device 80 is activated to cause relative motion between the two plates 70, 72 along axis S by shifting shift plate 72 from its releasing to its engaging position (i.e., creating relative motion between the two sets of carding strips 70*a'* and 72*a'*). Either of plates 70 and 72, or both, may be moved to establish the relative motion. This shifting creates a pinching action between the opposed needle-like elements 76 of the strips, and results in gentle capture of segment 52 over its entire exposed surface area. The cover sheet 28 which extends over the rest of the workpiece prevents the needle elements from gripping portions of the workpiece other than segment 52. Once segment 52 is securely engaged by picking mechanism 16B, the mechanism 163 raises, lifting the captured segment 52 off of the table while maintaining its planar configuration, and drives over to staging area C, where segment 52 is angularly positioned as desired and, as shift plate 72 is returned to its release position, segment 52 is gently deposited in its original planar shape for further processing.

A particular feature of the invention is the ability of the workpiece segment picking mechanism 16B to grasp and lift the workpiece segment 52 gently and uniformly, substantially over the surface area of the picked segment, without disturbing its shape and without disturbing the shape of the surrounding material sheet on the table. In the preferred embodiment, the cross-sectional area of picking mechanism 16B presented to the workpiece segment 52 is greater than the cross-sectional area of the workpiece segment 52 itself, and picking mechanism 16B actually overlies the bounding cover sheet material that surrounds the targeted workpiece segment 52. In this manner, the entire surface of the target workpiece segment 52 is subjected to a uniform distribution of picking and lifting forces as it is acquired and carried by the picker. Segment 52 can thus be grasped and transported with minimal or no distortion to the picked segment.

Successful operation of the above embodiment is enabled by the nature of the needle-like elements, i.e., that they are inherently flexible, and by the differentiating nature of the needle-penetrable material of segment 52 and the relatively needle-impenetrable material of the cover sheet. Various other combinations of cover sheet material and workpiece sheet material may be utilized in the invention, as long as the cover sheet and workpiece sheet materials can be adequately differentiated.

Figure 6:
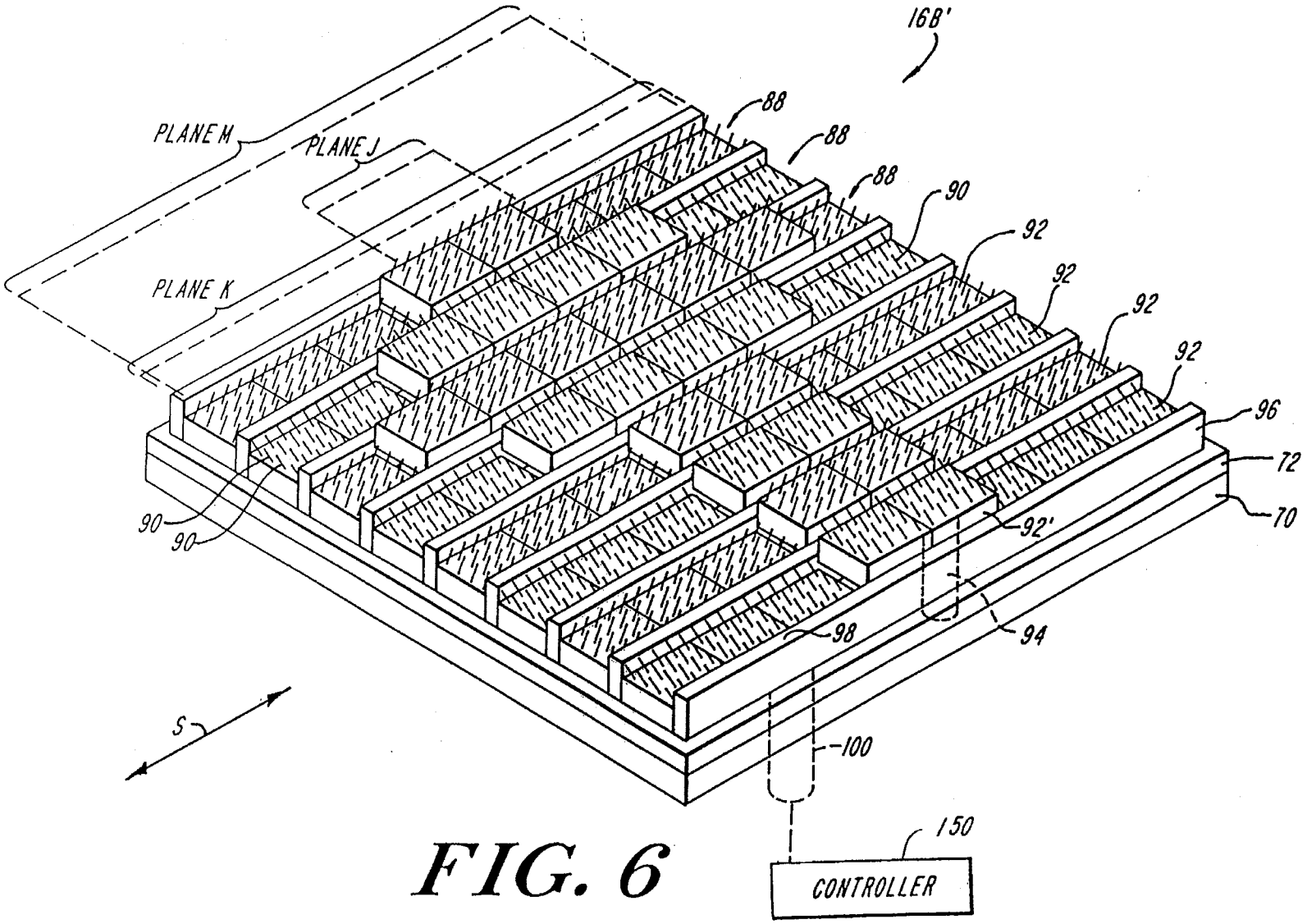
FIG. 6 is a perspective view of an alternative picker embodiment of the invention.

However, use of a cover sheet material may not be practical if the workpiece sheet material is characterized by surface tackiness, thereby requiring a possibly difficult cover sheet-from-workpiece separating operation. An alternative workpiece segment picking mechanism 16B', shown in FIG. 6, is particularly suited for use with workpiece sheet material having a surface tackiness. Mechanism 16B' has the same capabilities of mechanism 16B described above, preferably including having an array of relatively shiftable picker strips, such as carding strips 88 having needle-like elements 90, just as described above. In addition, each picker, e.g., carding strip, is formed of a multiplicity of individual picking sections 92. Each picking section, e.g., section 92' or section 92", is provided with its own linear actuator, e.g., actuator 94 (shown in dotted outline), and is individually actuatable normal to the principal planes of plates 70 and 72.

In this embodiment, the distal tips of the needle elements of an unactuated picking section lie in a resting plane M, and those distal tips of an actuated picking section extend out to a picking plane J. Thus the ability to individually actuate selected picking sections permits picking of any desired shape (subject to resolution limits posed by the area of the respective sections 92') without disturbing adjacent regions of the workpiece on the cutter table by actuation of only those picking sections which actually overly the target workpiece segment 52 desired to be picked.

The carding strips in the composite array are separated from each other by rigid stripper blades 96 affixed to plate 72. The distal top surfaces of the stripper blades 96 lie in a plane K intermediate of planes M and J, enabling the blades to strip the picked and held segment from the needles of the actuated sections 92 as these sections are retracted back into unactuated plane M. This assists in separation of the picker sections from the tacky material of the held picked segment. In a preferred embodiment, the distal ends of the stripper blades are provided with a non-stick coating 98, such as polytetrafluoroethylene (PTFE).

In the illustrated embodiment, the stripper blades are affixed to plate 72, but in other embodiments, the required relative motion of the stripper blades (with respect to picker sections) may be established by an actuator 100 (shown in dotted lines) coupled to the blades under the control of controller 150. These blade configurations may also be used with non-segmented stripper configurations, such as that of FIG. 5E.

While the above embodiment of the workpiece segment picker assemblies 16B and 16B' are described in a computer-controlled configuration where the array of carding strips is positioned on the end of an end effector apparatus 68 which is automatically controlled, it will be understood that the end effector apparatus 68 may be separately used with a manually operated assembly to drive the relative motion of plates 70 and 72, to control pick up of a workpiece. Such devices are particularly well suited for manually lifting and transporting flexible workpiece in an undisturbed manner.

Other embodiments of this invention which will occur to those skilled in the art are within the scope of the following claims. For example, other differentiating combinations of pickers and materials are also within the spirit and scope of the present invention. It will therefore be appreciated that the foregoing description provides method and apparatus for removing a cut workpiece segment of predetermined shape from a workpiece material sheet as further set forth in the following claims.

What is claimed is:

1. Apparatus for removing a cut workpiece segment of predetermined shape from a workpiece sheet, comprising:

A. dispenser means for dispensing on a support surface an assembly of materials to be cut, said assembly of materials including a cover sheet overlying a workpiece sheet, B. cutting means, adjustably positionable over said support surface, for cutting said assembly of materials on said support surface and creating a cut cover sheet segment from said cover sheet, having said predetermined shape and a cut workpiece segment from said workpiece sheet having said predetermined shape, wherein said cut cover sheet segment overlies said cut workpiece segment, C. cut cover segment pickup means, adjustably positionable over said work surface, for removing said cut cover sheet segment from said support surface while leaving said cut workpiece segment substantially non-distorted on said surface, D. cut workpiece segment pickup means, adjustably positionable over said support surface, for picking up said cut workpiece segment from said support surface, said cut workpiece segment pickup means being substantially incapable of coupling to said cover sheet and being selectively effective to couple to said cut workpiece segment, and E. controller means, for controlling, in sequence:

i) said dispenser means to dispense said assembly of materials on said support surface, ii) said cutting means to cut said assembly of materials and create said cut workpiece segment and said cut cover sheet segment, iii) said cut cover segment pickup means to remove said cut cover sheet segment from a remainder of said cover sheet to expose said cut workpiece segment, and iv) said cut workpiece segment pickup means to remove said exposed workpiece segment without distorting said cut workpiece segment while maintaining the remainder of said cover sheet and said workpiece sheet non-disturbed on said support surface.

2. Apparatus of claim 1 wherein said cut workpiece segment pickup means comprises a penetrating device opposite said support surface and wherein said workpiece sheet is penetrable by said penetrating device and said cover sheet material is substantially not penetrable by said penetrating device.

3. Apparatus of claim 2 wherein said cover sheet comprises a nonpermeable sheet.

4. Apparatus of claim 2 wherein said workpiece sheet is a woven fabric.

5. Apparatus of claim 2 wherein said penetrating device comprises an array of carding strips mounted on said workpiece segment pickup means, wherein each strip of said array is movable relative to adjacent strips of said array in a direction of a shift axis extending parallel to said support surface, each of said carding strips having a multiplicity of substantially parallel, resilient needle-like elements having distal tips extending toward said support surface from a base portion, wherein said needle-like elements of each strip are angularly offset with respect to said needle like elements of said adjacent strips, and a controller for selectively establishing said relative movement of said adjacent carding strips.

6. The apparatus of claim 5 further comprising a plurality of stripper blades positioned between adjacent ones of said carding strips, and associated means for selectively controlling said blades to move with respect to said carding strips in a direction perpendicular to said shift axis whereby said blades selectively extend beyond or below said distal tips of said needle-like elements.

7. Apparatus of claim 5 wherein said carding strips include a plurality of discrete substrips and said penetrating device further comprises actuator means for selectively displacing each of said substrips such that said distal tips of said needle-like elements of said substrips are selectively positionable between an advanced position and a retracted position, said advanced position being between said retracted position and said support surface, and further comprises a controller for selectively controlling said actuator means to establish a predetermined subset of said substrips to be in said advanced position.

8. The apparatus of claim 7 further comprising a plurality of stripper blades positioned between adjacent ones of said carding strips, each of said blades extending from said base portion to a point between said retracted and said advanced positions.

9. The apparatus of claim 8 wherein a distal end of said stripper blades is provided with a non-stick coating.

* * * * *